US005249958A

United States Patent [19]

Freber

[11] Patent Number: 5,249,958

[45] Date of Patent: Oct. 5, 1993

[54] TWO-SECTION BURNER

[75] Inventor: Donald E. Freber, Glendale, Mo.

[73] Assignee: Marquette Tool & Die Company, St. Louis, Mo.

[21] Appl. No.: 977,078

[22] Filed: Nov. 16, 1992

[51] Int. Cl.[5] ..... F23D 14/62

[52] U.S. Cl. ..... 431/354; 431/278; 126/39 R; 126/41 R; 239/600; 285/402

[58] Field of Search ..... 431/350, 354, 266, 278, 431/343, 355; 126/41 R, 39 R, 39 C, 39 H; 239/553.5, 553, 600; 285/396, 401, 402

[56] References Cited

U.S. PATENT DOCUMENTS

| | | | |
|---|---|---|---|
| 3,619,099 | 11/1971 | Moss et al. | 431/192 |
| 3,638,635 | 2/1972 | Drennan | 126/41 |
| 4,055,132 | 10/1977 | Stohrer, Jr. et al. | 113/116 |
| 4,092,975 | 6/1978 | Grammatopoulos | 126/41 |
| 4,305,372 | 12/1981 | Hahn | 126/41 |
| 4,485,972 | 12/1984 | Freber | 239/553.3 |
| 4,773,384 | 9/1988 | Koziol | 126/41 R |
| 4,986,254 | 1/1991 | Haen et al. | 126/41 |
| 4,989,579 | 2/1991 | Murphy et al. | 126/41 |
| 5,052,920 | 10/1991 | Warren | 431/354 |
| 5,186,158 | 2/1993 | Ferlin | 431/354 |

*Primary Examiner*—James C. Yeung

*Attorney, Agent, or Firm*—Polster, Lieder, Woodruff & Lucchesi

[57] ABSTRACT

The burner construction having a bottom pan and a cover is divided into two sections which are independently active when a gas fuel is supplied by independent venturi tubes. The tubes and bottom pans are formed with cam-locking elements which require a twisting motion in the receiving apertures in which the twisting of the tubes engages the cam-locking elements which pulls a shoulder on the tubes into a tight sealing contact against the pan thereby avoiding the need for tools or the use of gasket materials to form the seal.

10 Claims, 2 Drawing Sheets

FIG. 1.
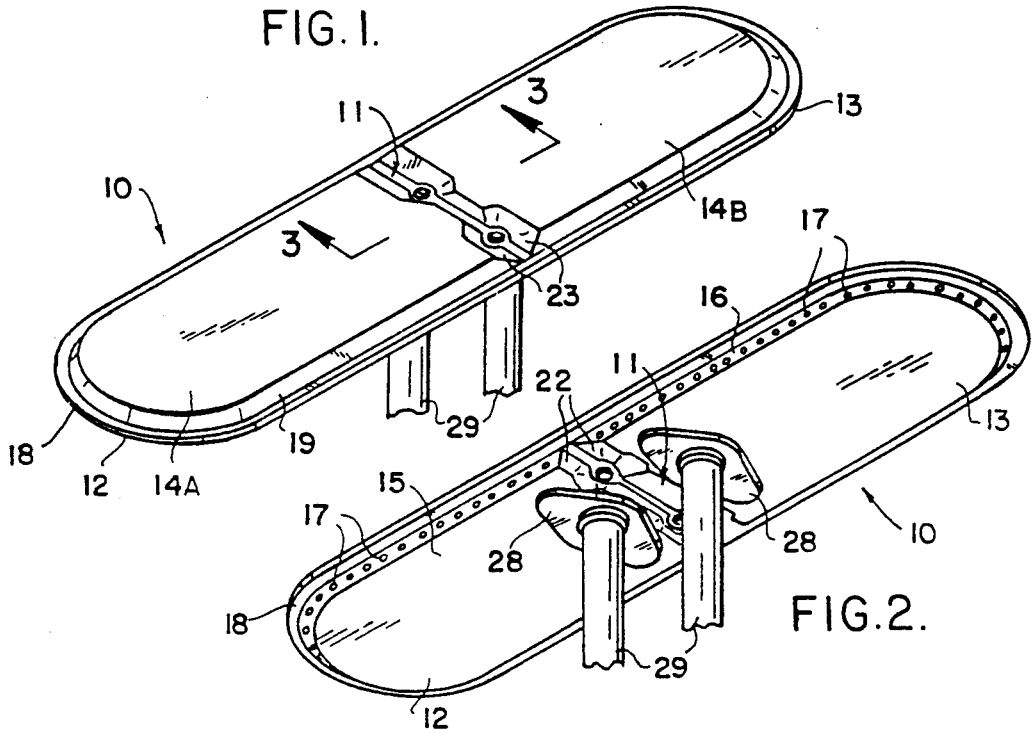
FIG. 2.
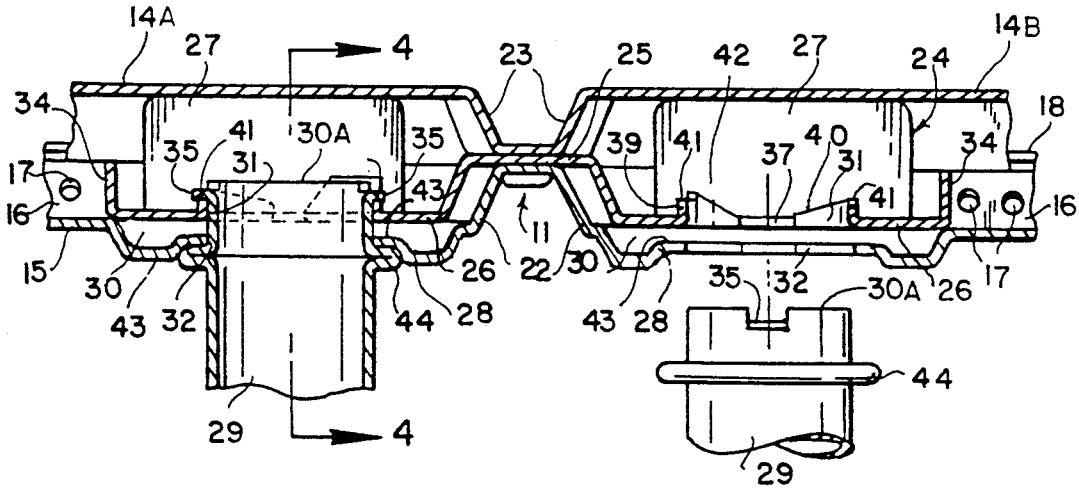
FIG. 3.

TWO-SECTION BURNER

BACKGROUND OF THE INVENTION

1. Field of the Invention

This invention is directed in general to a two-section burner, and more particularly to baffle means having a gas venturi tube twist lock incorporated in a spring plate for securing the supply venturi tube against gas leakage.

2. Description of the Prior Art

Two-section burners have been proposed for gas barbeque grills and the like in which a seal is employed between the two sections to effectively seal off each section so that there are two independent combustion chambers. Example of such construction is seen in U.S. Pat. No. 4,092,975 of Jun. 6, 1978, as well as in U.S. Pat. No. 4,986,254 of Jan. 22, 1991. The art also exhibits a single combustion chamber burner supplied with a gas fuel from a central venturi emitting the fuel in both directions, as seen in U.S. Pat. No. 4,485,972 of Dec. 4, 1984.

It appears that there is a common problem with burners of the shell character which relates to a secure and leak proof retention of the fuel supply venturi tube. Very little attention has been focused to present a solution for that problem as is evidenced by the number of burner constructions exhibited in the prior art with each one proposing a different form of a rigidly secured venturi.

SUMMARY OF THE INVENTION

The invention has as an object a solution to the problem of securing a fuel supply venturi in a sealed manner to a combustion chamber and providing for its removal through the placement of a baffle plate in the combustion chamber over a shallow depressed area through which the venturi is inserted, and incorporating a twist-locking means for the venturi end portion by utilizing a yieldable portion of the baffle to retain the venturi end portion open to the combustion space.

A further object of the invention is to incorporate, in a two-chamber burner, a double ended baffle means that is secured in a crimp seal between the chambers, and allow for resilient displacement of a base portion of the baffle means in each chamber at the receiving opening for a venturi tube, thereby imposing a holding force on the venturi tube to maintain a seal against fuel leakage while allowing for removal of the tube.

Other objects of the invention will be set forth in greater detail in the following description of a preferred embodiment.

BRIEF DESCRIPTION OF THE DRAWINGS

A preferred embodiment of the invention is illustrated in the following drawing view, wherein:

FIG. 1 is a perspective view of a two-chamber burner as seen from the top;

FIG. 2 is a perspective view from the under side of the two-chamber burner of FIG. 1 to show the under surface crimped formation;

FIG. 3 is a longitudinal sectional elevation taken along line 3—3 in FIG. 1 to disclose further details of the construction with one tube in seated position and another tube spaced from its seated position;

DETAILED DESCRIPTION OF THE EMBODIMENT

Figure 4:
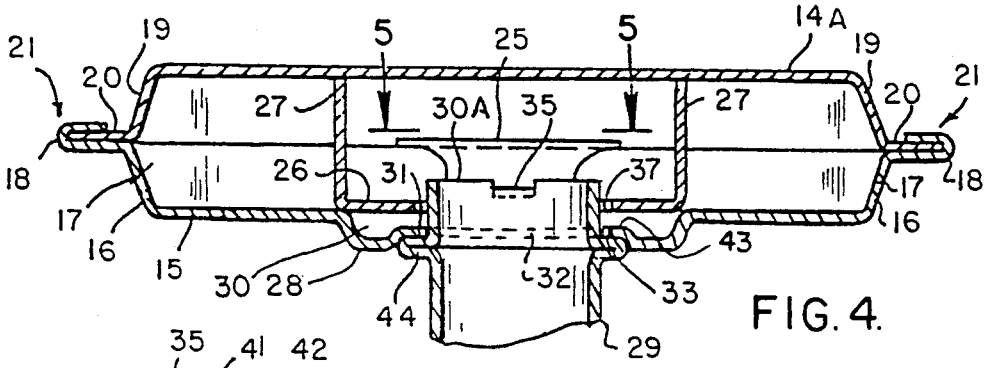
FIG. 4 is a transverse sectional view of a burner to illustrate the nature of a twist lock seal construction for a venturi tube connection into a burner chamber, the view being taken along line 4—4 in FIG. 3.

The burner pan of this invention is shown at 10 in perspective to be formed with a central indented rib 11 that extends transversely of or across the width of the burner pan to divide it into two sections 12 and 13. Each section is substantially identical, having a common cover divided into section 14A and section 14B. As seen in FIGS. 2 and 4 the interior of the burner 10 is formed with a flat bottom 15 having a raised rim 16 extending around the periphery of the bottom 15. The raised rim 16 is formed with a line of flame ports 17 which feed the fuel to maintain a flame at each port. It is preferred that the raised rim 16 seen in FIG. 4 is formed with a lip 18 which forms a seat to receive the edge margin 20 of the cover 14A. The cover 14A is placed with its downwardly directed rim 19 formed with a horizontal margin 20 engaged on the lip 18 which is then bent or crimped in a hemstitching operation at 21 to fold the bottom rim 16 up and over the margin 20 of the cover. This manner of securing the cover of the respective sections to the margin 16 of the bottom 15 extends around both burner sections 12 and 13. However, the rib 11 (FIG. 1) which separates the two sections 12 and 13, as seen in FIGS. 1 and 3 is formed by raised walls 22 in the bottom 15 and downwardly directed walls 23 in the cover 14A. When the cover 14A is positioned on the bottom 15, the walls 22 and 23 are placed in abutment and are spot welded or otherwise attached to isolate the sections 12 and 13 from each other. The covers 14A and 14B are in this view of FIG. 1 in one piece, as is the bottom 15 so the walls 22 and 23 are integral.

Figure 5:
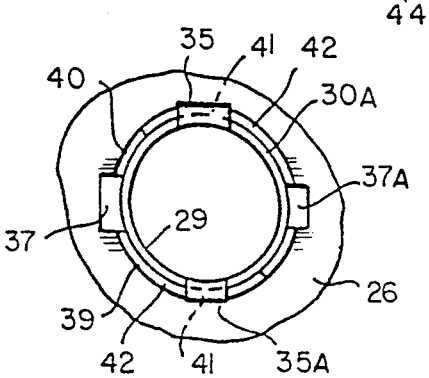
FIG. 5 is a top plan view of means for retaining a venturi tube in one of the chambers shown in FIG. 1.
Figure 7:
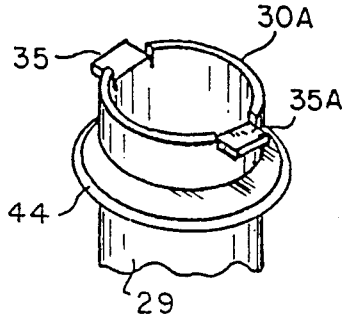
FIG. 7 is a disassembled perspective view of the male and female formations of a twist to lock or unlock a venturi tube.
Figure 6:
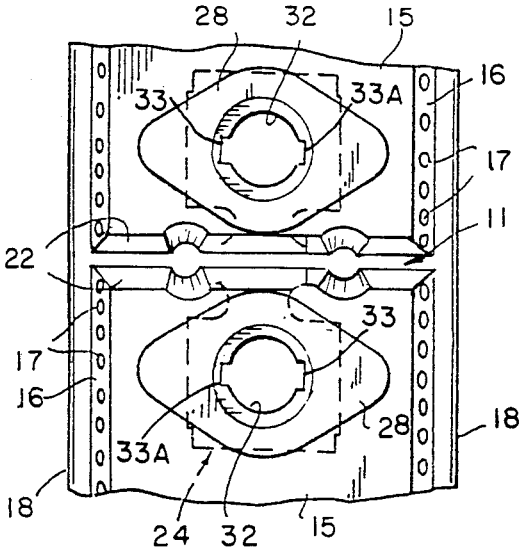
FIG. 6 is a fragmentary enlarged view from beneath the central area of FIG. 2 shown without the gas tubes installed.
Figure 8:
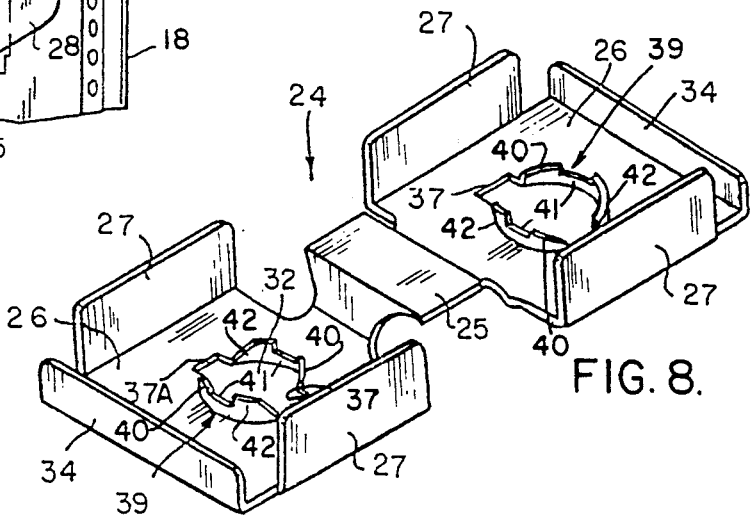
FIG. 8 is an enlarged perspective view of the dual locking means for a pair of tubes of the character seen in FIG. 3.

In a burner of the character shown in FIGS. 1, 2 and 3 the improvement resides in the baffle device 24 shown in perspective detail in FIG. 8 and in a plan view of one opening for a venturi tube in FIG. 5. The baffle is installed as a unitary part by placing the interconnecting bridge 25 between the walls 22 and 23 (FIG. 3) before they are secured together. This fixes the baffle device 24 with half in each combustion chamber 12 and 13. Each baffle half has a base 26 flanked on opposite longitudinal sides by raised walls 27 having a dimension that is sufficient to be contacted by both the base 15 and the cover 14, to hold the base 26 down over a shallow dished recess 28 formed in the bottom 15 and each recess forms a chamber 30 under the base 26 of the baffle 24 located therein. The gauge of the material in each base 26 of baffle 24 is such that the area of the recess 28 possesses a degree of spring-like resilience capable of yielding (See FIG. 4) during the securing of the gas outlet end 30A of each venturi tube 29 (See FIG. 7) in an opening 32 in the recess wall 28 and a matching opening 31 in the base wall 26 of baffle 24. The opening 32 of recess 28 is further formed with diametrically spaced notches 33 and 33A (See FIG. 6) in the opening 32 of the recessed surface 28 for cooperating with the gas fuel supply tube 29. Means for limiting the resiliency or flexability of the base wall 26 is obtained by the formation of a low flange 34 on the outer edges of the base (See FIG. 8).

The gas supply venturi tube 29 for each recessed chamber 30 has a pair of diametrically opposite projecting tabs 35 and 35A intended to engage in a mating tapering rim formation 36 of the openings 31 in the base 26 so the tabs 35 and 35A engage with the flanges. Thus on inserting the tabs 35 and 35A on a venturi tube 29 through the notches 33 and 33A of opening 32 in the wall of the shallow recess 28 the tabs enter the opening 31 of the base 26, which also has matching notches 37 and 37A opening adjacent axially directed control flanges 39 in the base 26. The control flanges 39 (See FIGS. 5 and 8) around the openings 31 each have a raised tapered section 40 of a short circumferential or circular extent, a circular non-tapered section 41 and an axially raised stop section 42. By suitably twisting the tube 29 a cam lock is formed by the projecting tabs 35 entering notches 37 and tabs 35A entering notches 37A to engage on the control flanges 39 which draw the base 26 down and concurrently draws a tube flange 44 up, into and against the indented surface 43 of the recess 32. This twist lock action creates the desired seal of the venturi tube flange 44 on the surface 43 so gas does not leak out under the burner and around the entry of the venturi tube at the shallow recess 30.

It is seen in FIGS. 5–8 that the notches 33 and 33A have a width difference in that the notch 33 is wider than notch 33A, and these respective notches are reversed as to location in the respective openings 32. The same notch width difference is seen in FIG. 8 as between wide notches 37 and narrow notches 37A. Further the wide notches 33 in opening 32 and 37 in the base 26 line up, as do the respective narrow notches 33A and 37A. The wide and narrow notches are made to receive only the wide tabs 35 and narrow tabs 35A (FIG. 7). As a result of this difference the gas tubes 29 can be inserted in only one position. For example, the tubes 29 are initially located so they point substantially parallel with the lengthwise dimension of the pan 15 but in opposite directions. Then as the tubes are rotated to be at ninety degrees with the lengthwise dimension of the pan 25, and also pointed to the same side, the control flanges 39 cause the tube tabs 35 and 35A to pull the ends 30A of the tubes 29 into the openings 32 so the tube flanges 44 seat against the indented surfaces 43 and the tube ends are firmly seated and locked into position for gas flow as desired with the tabs 35 and 35A engaged on the flange surfaces 41.

In view of the foregoing disclosure a unique feature of the invention resides in the contruction of the burner so that the purchaser can effect the assembly of the gas tubes without any tools since the gas tubes are so constructed that the act of inserting the gas tubes in the apertures requires fitting the securing elements on the gas tubes in the proper slots and then twisting the gas tube to secure it in position. A further unique feature of the invention is the formation of the flange on the gas tubes and the cooperation of the indented surface so as to form a gas type seal, thereby avoiding the use of any gasket or the like as the seal is secure without such addition.

Variations in the structure disclosed herein are possible without departing from a structure which may be equivalent in function or configuration.

What is claimed is:

1. A burner having a combustion chamber enclosed by a bottom pan and a cover therefor, and an aperture for the admission of a gas fuel to the chamber, the improvement comprising:

a) a wall forming the bottom surface of the bottom pan and said wall having a recessed portion formed therein having an aperture for the admission of a gas fuel;

b) a baffle secured in the combustion chamber between the wall forming the bottom pan and the cover, said baffle having a base directed over the gas admission aperture and covering said recessed portion and said aperture therein, said base having an aperture therein registering with said recessed portion aperture;

c) a gas fuel admitting tube having an open end received in said registering apertures and a flange formed thereon spaced from and adjacent said open end in position to engage against the recessed portion; and d) retaining means formed on said base and on said open end of the gas admitting tube, said retaining means being in position to engage each other upon insertion of the tube open end into said registering apertures for retaining said tube in position to admit fuel to the chamber, said retaining means further being effective upon tube rotation manipulation while inserted in said registered apertures to draw said tube flange into sealing contact with said recessed portion.

2. The improvement set forth in claim 1 wherein said retaining means on said base and on said tube open end includes a raised rim on said base aperture having an inclined edge and a lateral projection on said tube end having a configuration to engage said inclined edge on said base aperture, said tube lateral projection engaging with said tapered edge being movable upon tube rotation to slide along said tapered edge to effect longitudinal movement of said tube in a direction to have said flange move to seal said recess aperture.

3. The improvement set forth in claim 1 wherein said base on said baffle being yieldable in response to said retaining means drawing said gas tube flange into sealing contact with said shallow recess.

4. The improvement set forth in claim 1 wherein said retaining means formed on said base having an axially formed rim with a tapered section and said tube having laterally directed projections slidably engaged on said tapered section for relative rotation between said tapered section and said lateral projections to effect a twist-lock therebetween.

5. A burner combustion chamber having provision for admitting a gaseous fuel to the chamber in which the construction thereof comprises:

a) an enclosure for the combustion chamber including top and bottom walls in spaced relation and a fuel admitting opening, in said bottom wall;

b) a portion of said bottom wall being recessed in a direction away from said top wall, said fuel admitting opening being located in said bottom wall recess and being formed with a pair of diametrically opposite notches of different widths;

c) a baffle element positioned in the combustion chamber having a wall portion adjacent said recessed portion of said bottom wall, said baffle element having an aperture therein in position to be aligned with said fuel admitting opening in said bottom wall recess;

d) flange means formed around the margin of said baffle aperture, said flange means being interrupted by notch means positioned to substantially match said bottom wall pair of notches, and said flange means on said baffle aperture having pairs of marginal flange means including first tapering flanges and stop flanges in diametrically opposite positions and a pair of substantially flat flange means interrupting said first and stop flanges;

e) a gas fuel supply pipe having an end portion formed with outwardly directed tabs in diametrically spaced alignment, said tabs having different widths for passage through said matching different widths of aligned baffle aperture and bottom wall recess opening; and f) flange means on said gas fuel supply pipe in position to enter said bottom wall recess opening and assume a substantial seal therein upon rotation of said gas fuel supply pipe to move said outwardly directed tabs into engagement with said first tapering flanges and onto said flat flange means.

6. The burner combustion chamber set forth in claim 5 wherein said baffle element wall portion adjacent said recessed portion of said bottom wall is relatively yieldable to hold said gas fuel supply pipe flange means sealed with said bottom wall recess opening.

7. The burner combustion chamber set forth in claim 5 wherein said top and bottom walls have margins in sealed engagement to retain the fuel in the chamber, and flame port means is formed in one of said top and bottom walls for the passage of the fuel to the exterior of said chamber for feeding the flames of combustion.

8. A burner having a combustion chamber for the reception of a gaseous fuel, the improvement comprising:

a) a top and a bottom wall having mating flanged rims engaged to enclose a combustion chamber;

b) rib means formed in said top and bottom walls and engaged in abutment for dividing said combustion chamber into two sections independent of each other;

c) said bottom wall for each combustion chamber section being formed with a bottom aperture open to the exterior of the combustion chamber section, each aperture being formed with diametrically related notches having different sizes;

d) baffle means in each combustion chamber section positioned adjacent said bottom apertures, each baffle means having an aperture formed with diametrically related notches having different sizes and raised flanges directed toward said top wall, said aperture with different size notches and raised flanges being in cooperative alignment with said bottom notched apertures; and e) a gas fuel supply conduit for each chamber section having an end portion formed with securing tabs and a circumferential flange, said securing tabs passing through said cooperatively aligned apertures and notches to bring said circumferential flange into contact with said bottom wall, and said conduit being rotatable in said aligned apertures to effect tabs engaging on said raised flange for effecting a sealed engagement of said circumferential flange on said bottom wall.

9. The burner combustion chamber improvement set forth in claim 8 wherein baffle means in each combustion chamber section are in connection through bridge means secured in position by said rib means which divides said combustion chamber into said two independent sections.

10. The burner combustion chamber improvement set forth in claim 8 wherein said bottom wall for each combustion chamber section is formed with a recess portion surrounding said bottom aperture; said baffle means aperture is spaced from said recessed portion; and said gas fuel supply conduit securing tabs flex said baffle means adjacent its said aperture upon said conduit rotation..

* * * * *